US007654689B2

(12) United States Patent
Chang

(10) Patent No.: US 7,654,689 B2
(45) Date of Patent: Feb. 2, 2010

(54) LED LAMP ASSEMBLY

(75) Inventor: Shao-Han Chang, Taipei Hsien (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 110 days.

(21) Appl. No.: 11/858,124

(22) Filed: Sep. 20, 2007

(65) Prior Publication Data

US 2008/0298072 A1 Dec. 4, 2008

(30) Foreign Application Priority Data

Jun. 1, 2007 (CN) ..... 2007 1 0200745

(51) Int. Cl.
*F21V 1/00* (2006.01)
*F21V 7/00* (2006.01)

(52) U.S. Cl. ..... 362/248; 362/240; 362/241; 362/97.1; 362/301

(58) Field of Classification Search ..... 362/240, 362/247, 248, 249, 298, 300–303, 351, 97.1–97.4, 362/237, 238, 241, 249.02, 360; 349/58, 349/62, 63, 67
See application file for complete search history.

(56) References Cited

U.S. PATENT DOCUMENTS 4,271,408 A * 6/1981 Teshima et al. ..... 345/83
6,431,728 B1 * 8/2002 Fredericks et al. ..... 362/244
6,491,412 B1 * 12/2002 Bowman et al. ..... 362/241
6,729,746 B2 * 5/2004 Suehiro et al. ..... 362/241
6,886,982 B2 * 5/2005 Reynolds ..... 383/68
7,181,378 B2 * 2/2007 Benitez et al. ..... 703/2

FOREIGN PATENT DOCUMENTS

TW 1224230 11/2004

* cited by examiner

*Primary Examiner*—Thomas M Sember
(74) *Attorney, Agent, or Firm*—Frank R. Niranjan

(57) ABSTRACT

An exemplary LED lamp includes a housing having an opening, a printed circuit board, at least one LED, a light reflective element, at least one light-shielding sheet and a lamp cover. The printed circuit board is positioned on a bottom of the housing. The LED is electrically connected with the printed circuit board. The light reflective element defines at least one through hole, the LED passing through the corresponding through hole. The at least one light-shielding sheet corresponds to the at least one LED respectively. Each light-shielding sheet comprises a bottom reflective plate and a pair of opposite sidewalls extending from two opposite ends of the bottom reflective plate. A plurality of light holes is defined at ends of the bottom reflective plate adjacent to the two opposite sidewalls. The lamp cover is fixed on the opening of the housing. The LED lamp assembly has a uniform luminance.

18 Claims, 13 Drawing Sheets

LED LAMP ASSEMBLY

CROSS-REFERENCE TO RELATED APPLICATIONS

This application is related to two copending U.S. patent applications, application Ser. No. 11/766,106 filed on Jun. 21, 2007, entitled "LED LAMP ASSEMBLY", application Ser. No. 11/773,979, filed on Jul. 6, 2007, entitled "LED LAMP ASSEMBLY". In the copending applications, the inventor is Shao-Han Chang. All of the copending applications have the same assignee as the present application. The disclosures of the above identified application are incorporated herein by reference.

BACKGROUND OF THE INVENTION

1. Field of the Invention

The present invention relates to a lamp assembly, and particularly to a light emitting diode lamp assembly employed in a direct type backlight module of a liquid crystal display.

2. Discussion of the Related Art

Typically, light emitting diodes (LEDs) are preferred over other types of light sources because LEDs exhibits low energy consumption, long service life, and other advantages. Therefore, LEDs are widely used as light sources.

FIG. 1 illustrates a typical LED lamp assembly 10 using LEDs as a light source. The LED lamp assembly 10 includes a housing 11, a printed circuit board 12, a plurality of side-lighting type LEDs 13, a light reflective module 14, a plurality of circular reflective layers 15 and a lamp cover 16. The housing 11 is an elongated, hollow structure having an opening 112. The LEDs 13 are arranged apart and electrically connected to the printed circuit board 12. The printed circuit board 12 with the LEDs 13 is disposed on a bottom surface of the housing 11. The light reflective module 14 includes a rectangular bottom reflective plate 144 and four connecting sidewalls 142 extending from a periphery of the bottom reflective plate 144. The bottom reflective plate 144 defines a plurality of through holes 146, configured for allowing the light-emitting portions of the LEDs 13 to pass through. The light reflective module 14 can be correspondingly mounted into the housing 11 via the opening 112. The circular reflective layers 15 are positioned at the tops of the LEDs 13 respectively. The lamp cover 16 is fixed on the opening 112 of the housing 11. Light from the light-emitted portions of the LEDs 13 is substantially reflected at the sidewalls 142 and the bottom reflective plate 144, finally outputted from the lamp cover 16. With the help of the light reflective module 14, an efficiency of utilization of light energy of the LED lamp assembly 10 is increased.

Nevertheless, the brightness above the LEDs 13 of the LED lamp assembly 10 is decreased due to the light reflection off the circular reflective layers 15, and a plurality of dark areas between the two adjacent LEDs 13 still occur. Accordingly a uniform brightness of the LED lamp assembly 10 is low.

What is needed, therefore, is an LED lamp assembly that overcomes the above mentioned disadvantages.

SUMMARY

An LED lamp assembly according to a preferred embodiment includes a housing having an opening, a printed circuit board, at least one LED, a light reflective element, at least one light-shielding sheet and a lamp cover. The printed circuit board is positioned on a bottom of the housing. The LED is electrically connected with the printed circuit board. The light reflective element defines at least one through hole, the LED passing through the corresponding through hole. The at least one light-shielding sheet corresponds to the at least one LED respectively. Each light-shielding sheet comprises a bottom reflective plate and a pair of opposite sidewalls extending from two opposite ends of the bottom reflective plate. A plurality of light holes is defined at ends of the bottom reflective plate adjacent to the two opposite sidewalls. The lamp cover is fixed on the opening of the housing. In addition, the light reflective element in the LED lamp assembly can be replaced by a high reflective layer formed on a top surface of the printed circuit board or a high reflective plate positioned on a top surface of the printed circuit board.

Other advantages and novel features will become more apparent from the following detailed description of various embodiments, when taken in conjunction with the accompanying drawings.

BRIEF DESCRIPTION OF THE DRAWINGS

The components in the drawings are not necessarily drawn to scale, the emphasis instead being placed upon clearly illustrating the principles of the present LED lamp assembly. Moreover, in the drawings, like reference numerals designate corresponding parts throughout the several views, and all the views are schematic.

DETAILED DESCRIPTION OF THE PREFERRED EMBODIMENTS

Figure 1:
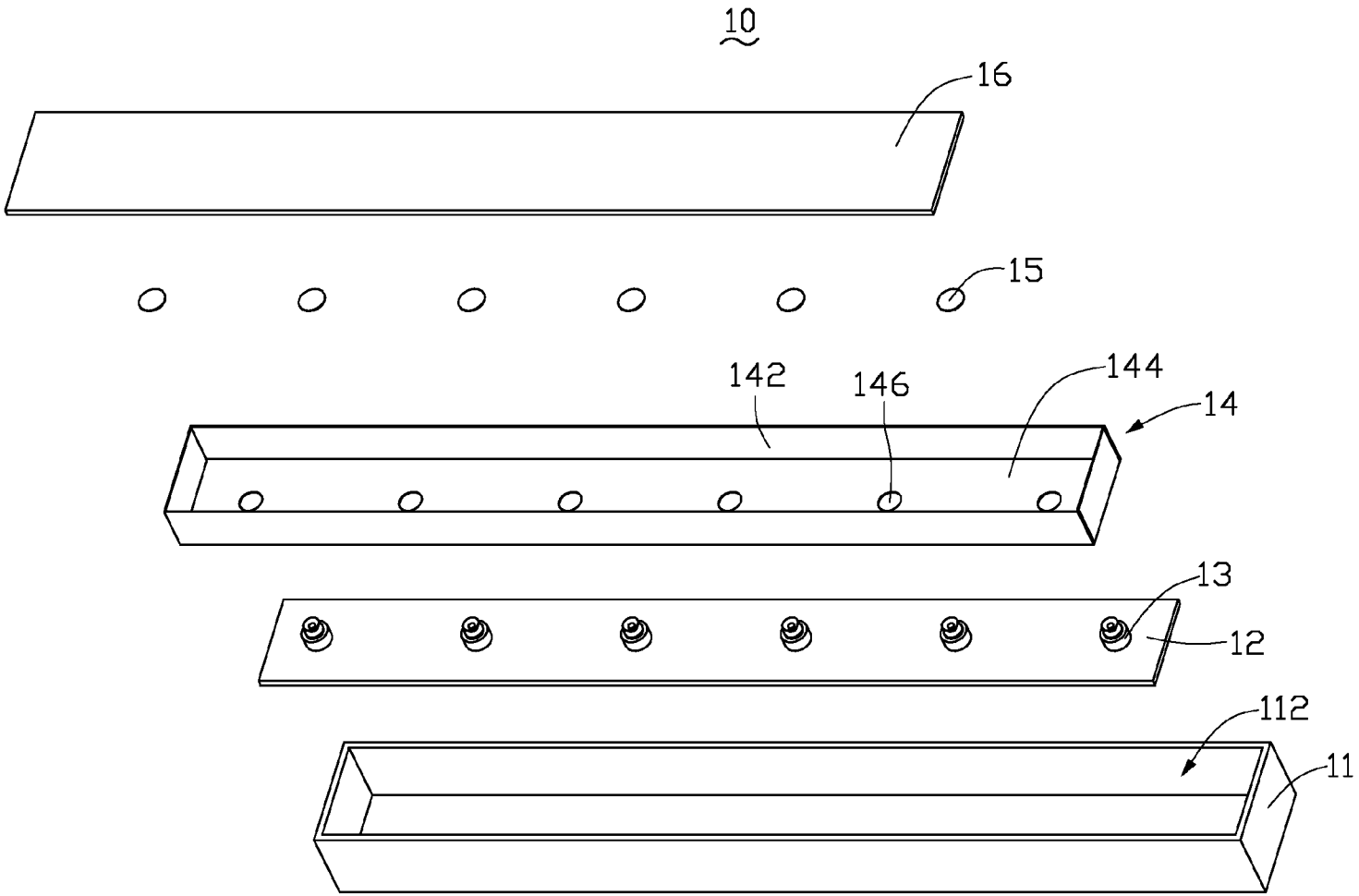
FIG. 1 (RELATED ART)
FIG. 1 is an exploded, isometric view of a conventional LED lamp assembly.

References will now be made to the drawings to describe preferred embodiments of the present LED lamp assembly, in detail.

Referring to FIGS. 2 through 5, an LED lamp assembly 20 in accordance with a first preferred embodiment of the present invention is shown. The LED assembly 20 includes a housing 21, a printed circuit board 22, a plurality of side-emitting type LEDs 23, a light reflective element 24, a plurality of light-shielding sheets 25, and a lamp cover 26. The housing 21 is an elongated, hollow structure including four sidewalls 214. The sidewalls 214 cooperatively defines a receiving opening 212. The LEDs 23 are separately arranged and electrically connected to the printed circuit board 22. The printed circuit board 22 including the LEDs 23 is disposed in the receiving opening 212 on a bottom surface of the housing 21.

Figure 5:
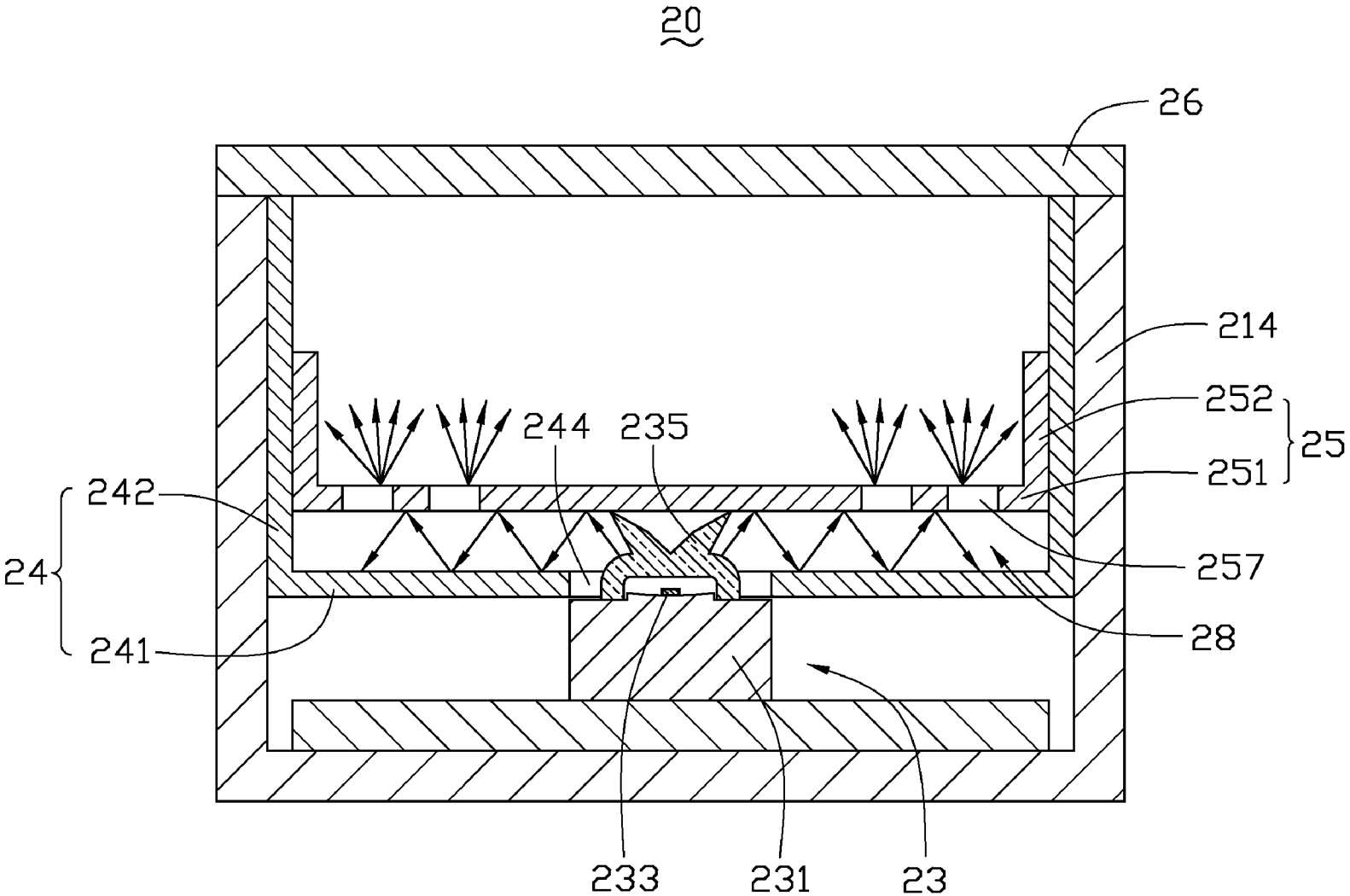
FIG. 5 is a side, enlarged, cross-sectional view of the LED lamp assembly of FIG. 3, taken along line V-V thereof.

Referring to FIG. 5, each LED 23 includes a base portion 231, a semiconductor chip 233 fixed on the base portion 231, and an optical lens 235. The optical lens 235 is bonded or snap-fitted onto the base portion 231 sealing the semiconductor chip 233 within. A width of the base portion 231 is larger than that of the optical lens 235.

Figure 2:
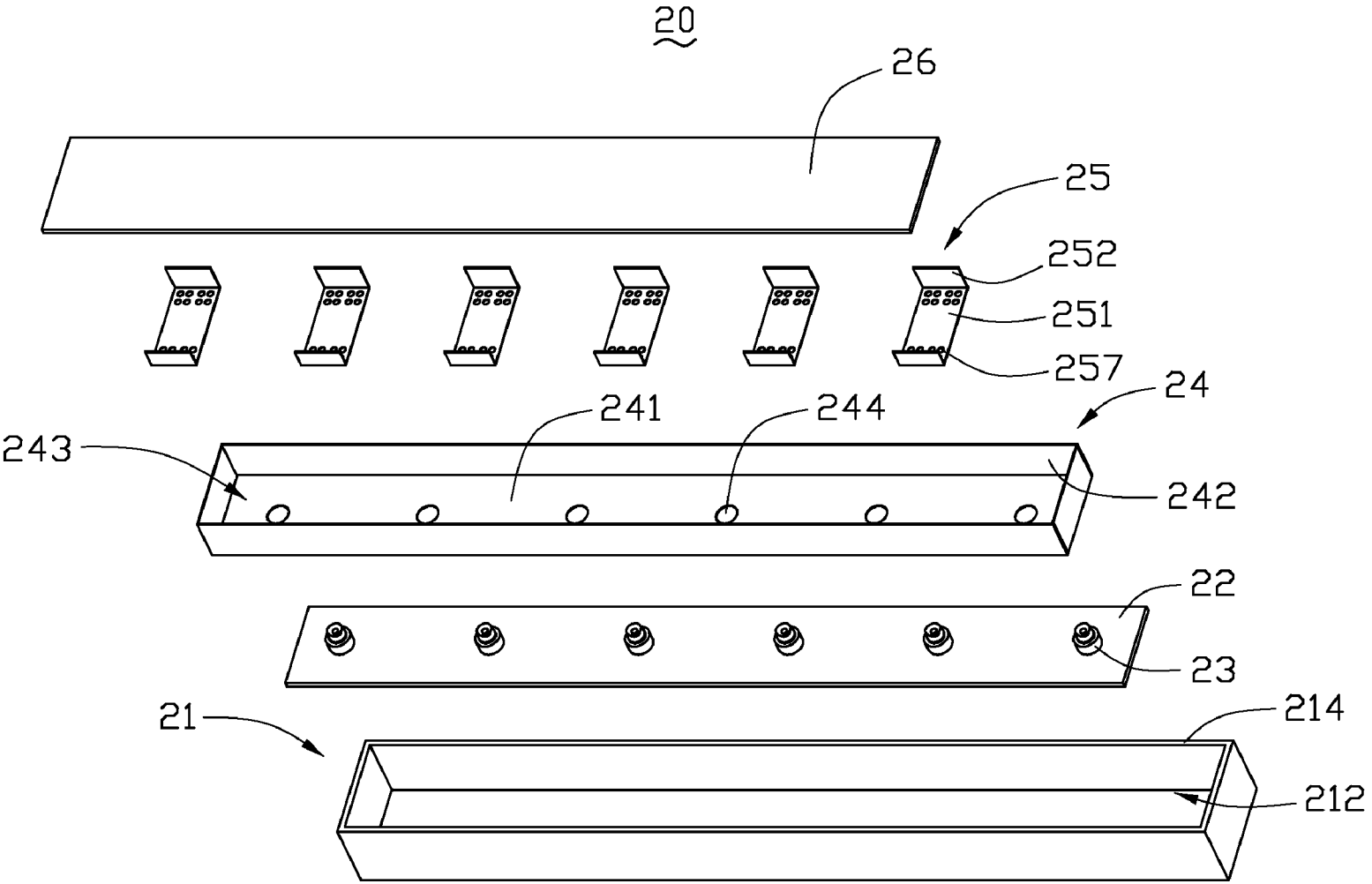
FIG. 2 is an exploded, isometric view of an LED lamp assembly according to a first preferred embodiment of the present invention.
Figure 3:
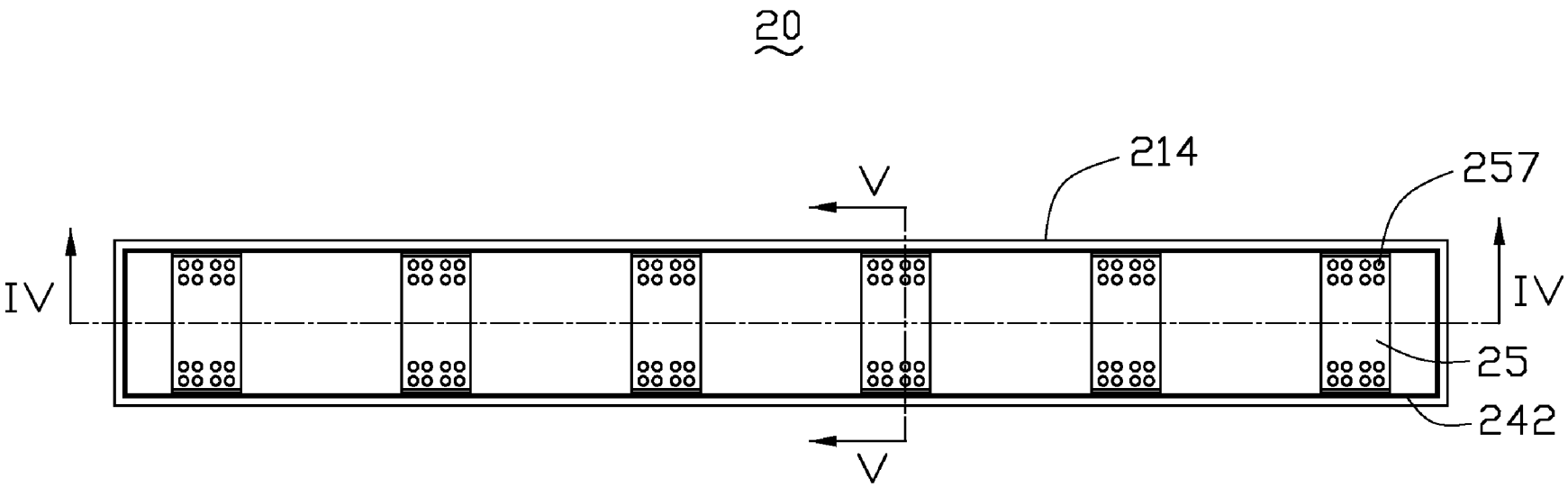
FIG. 3 is a top plan view of the LED lamp assembly without a lamp cover.
Figure 4:
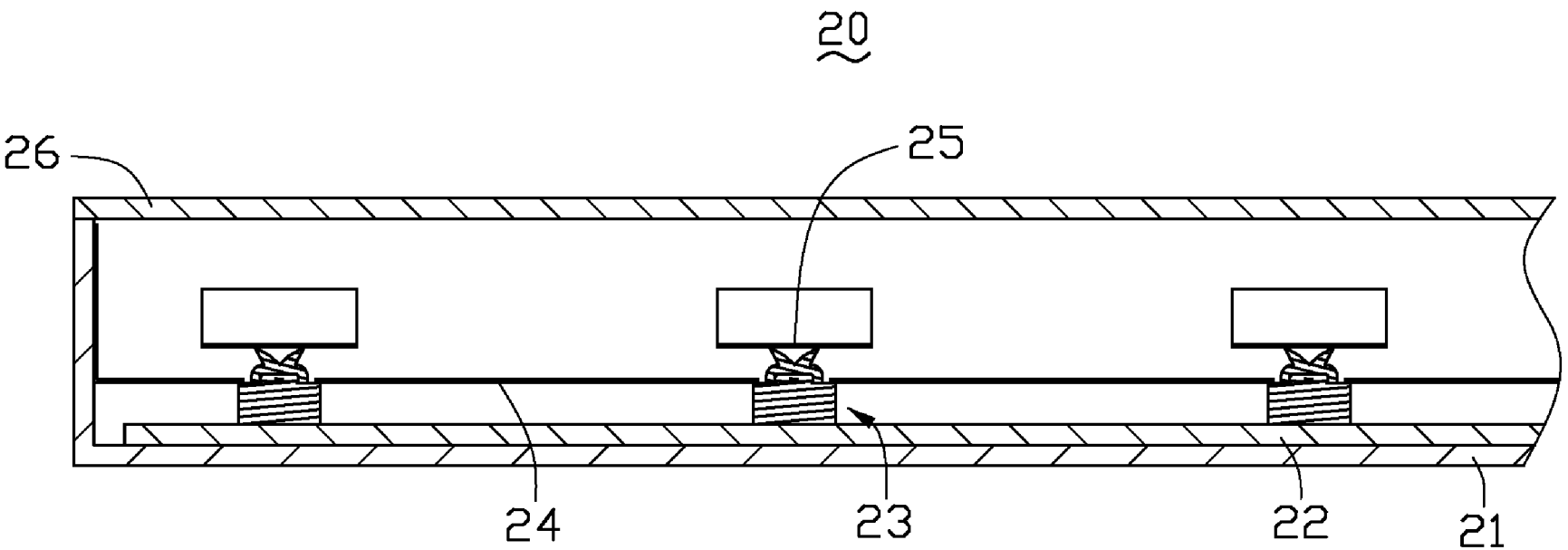
FIG. 4 is a side, enlarged, partial, cross-sectional view of the LED lamp assembly of FIG. 3, taken along line IV-IV thereof.

Also referring to FIGS. 2 through 4, the light reflective element 24 includes a base 241 and four sidewalls 242 extending from a periphery of the base 241. The base 241 and the sidewalls 242 cooperatively define a cavity 243. The base 241 defines a plurality of through holes 244 for allowing the optical lenses 235 of the LEDs 23 to pass through the corresponding through holes 244. The base portions 231 of the LEDs 23 support the light reflective element 24.

Each light-shielding sheet 25 includes a bottom reflective plate 251 and a pair of opposite sidewalls 252 extending from two opposite ends of the bottom reflective plate 251. A plurality of light holes 257 are defined at ends of the bottom reflective plate 251 adjacent to the two opposite sidewalls 252. In this embodiment, the light holes 257 are of the same shapes and sizes, and are formed in a matrix manner at the ends of the light-shielding sheet 25. Each light-shielding sheet 25 is disposed in the cavity 243 of the light reflective element 24 and the two opposite sidewalls 252 of each light-shielding sheet 25 are connected to the sidewalls 242 of the light reflective element 24 respectively. Each LED 23 is covered by the corresponding light-shielding sheet 25. Generally, the light-shielding sheet 25 is integrally manufactured by stamping a raw metal sheet. Surfaces of the bottom reflective plate 251 and the sidewalls 252 are high reflective surfaces; the bottom reflective plate 251 and the sidewalls 252 are made of a combination of metal materials and/or plastic materials.

The lamp cover 26 is fixed on the opening 212 of the housing 21. The lamp cover 26 can be either a transparent plate or a light diffusion plate. The sidewalls 242 of the light reflective element 24 and the sidewalls 214 of the housing 21 may, correspondingly, further define a plurality of latching elements (not shown), thus the light reflective element 24 and the housing 21 can be assembled together securely.

Also referring to FIG. 5, in assembled, the light-shielding sheets 25, and the light reflective element 24 cooperatively define a light-mixing space 28. Light from the optical lens 235 of the LEDs 23 is reflected many times between the bottom reflective plate 251 of the light-shielding sheets 25 and the base 241 of the light reflective element 24 before substantially exiting at an area between the two adjacent light-shielding sheets 25. As a result, a light brightness above the gaps of the LED lamp assembly 20 is increased. In addition, a light brightness above the LEDs 23 of the LED lamp assembly 20 is decreased due to the light reflection of the light-shielding sheets 25. Furthermore, some of the light projects to the lamp cover 26 via the light holes 257 of the light-shielding sheets 25. Since the light holes 257 are formed on the two sides of each of the light-shielding sheets 25 adjacent to the sidewalls 214 of the housing 21, a light brightness of the two side portions of the LED lamp assembly 20 is increased. Thus, a uniformity of light output from the LED lamp assembly 20 is increased.

Figure 6:
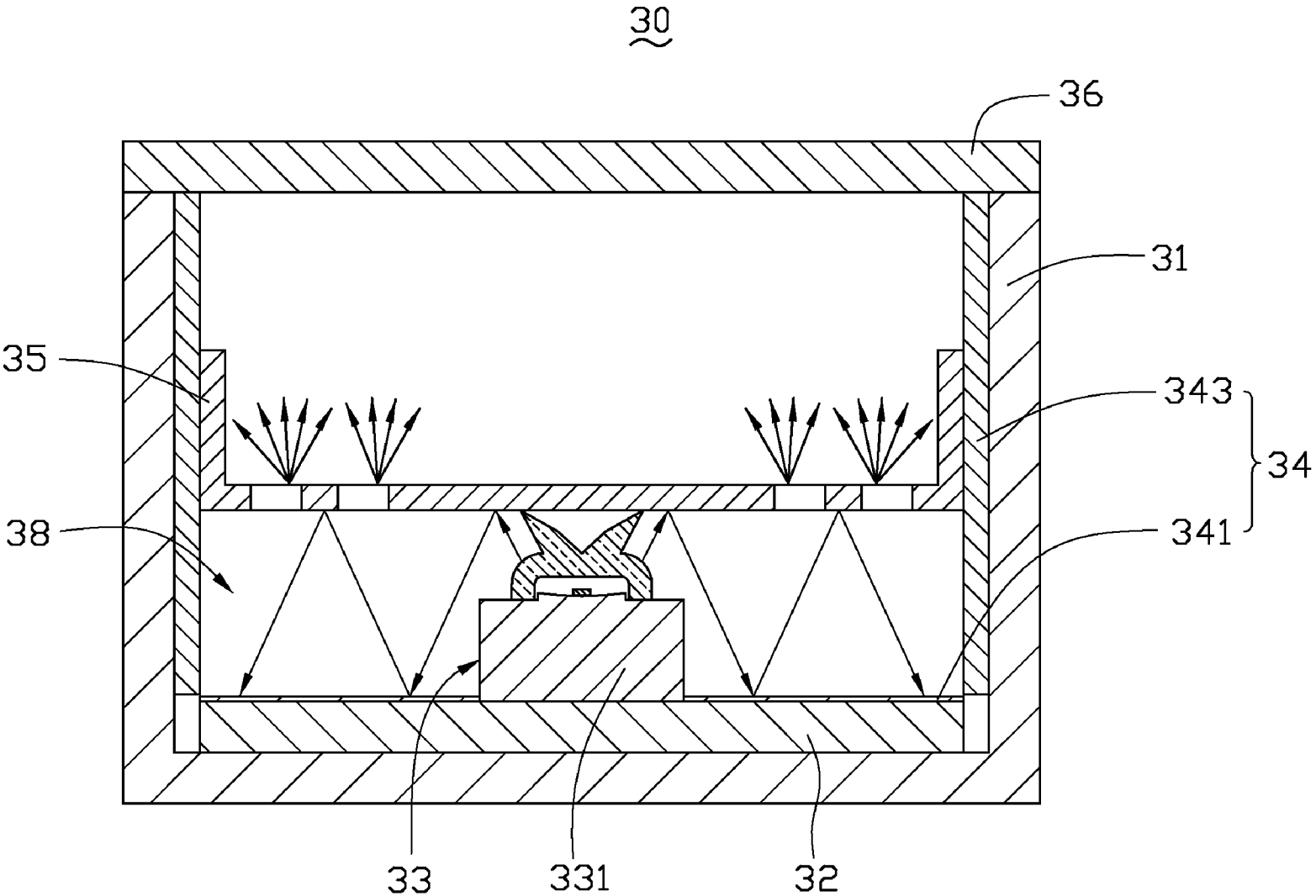
FIG. 6 is a side, cross-sectional view of the LED lamp assembly according to a second preferred embodiment of the present invention.

Referring to FIG. 6, an LED lamp assembly 30 in accordance with a second preferred embodiment of the present invention is shown. The LED assembly 30 includes a housing 31, a printed circuit board 32, a plurality of side-emitting type LEDs 33, a light reflective element 34, a plurality of light-shielding sheets 35, and a lamp cover 36. The LED lamp assembly 30 is similar in principle to the LED lamp assembly 20 of the first preferred embodiment except that the light reflective element 34 is different from the light reflective element 24. The light reflective element 34 includes a base 341 and a plurality of sidewalls 342 separate from the base 341. The base 341 defines a plurality of through holes (not labeled) for allowing the base portion 331 of the LEDs 33 to pass through the corresponding through holes. The base 341 is in contact with the printed circuit board 32. The plurality of sidewalls 343 is fixed to corresponding sidewalls (not labeled) of the housing 31. The light-shielding sheets 35, and the light reflective element 34 cooperatively define a light-mixing space 38.

Since the base 341 is disposed on the printed circuit board 32, the light-mixing space 38 is larger than the light-mixing space 28 of the first preferred embodiment. Light from the LEDs 33 can mix more fully in the light-mixing space 38 when compared with the light-mixing space 28. Therefore, the uniformity of light output from the LED lamp assembly 30 is better than the uniformity of light output from the LED lamp assembly 20.

Figure 7:
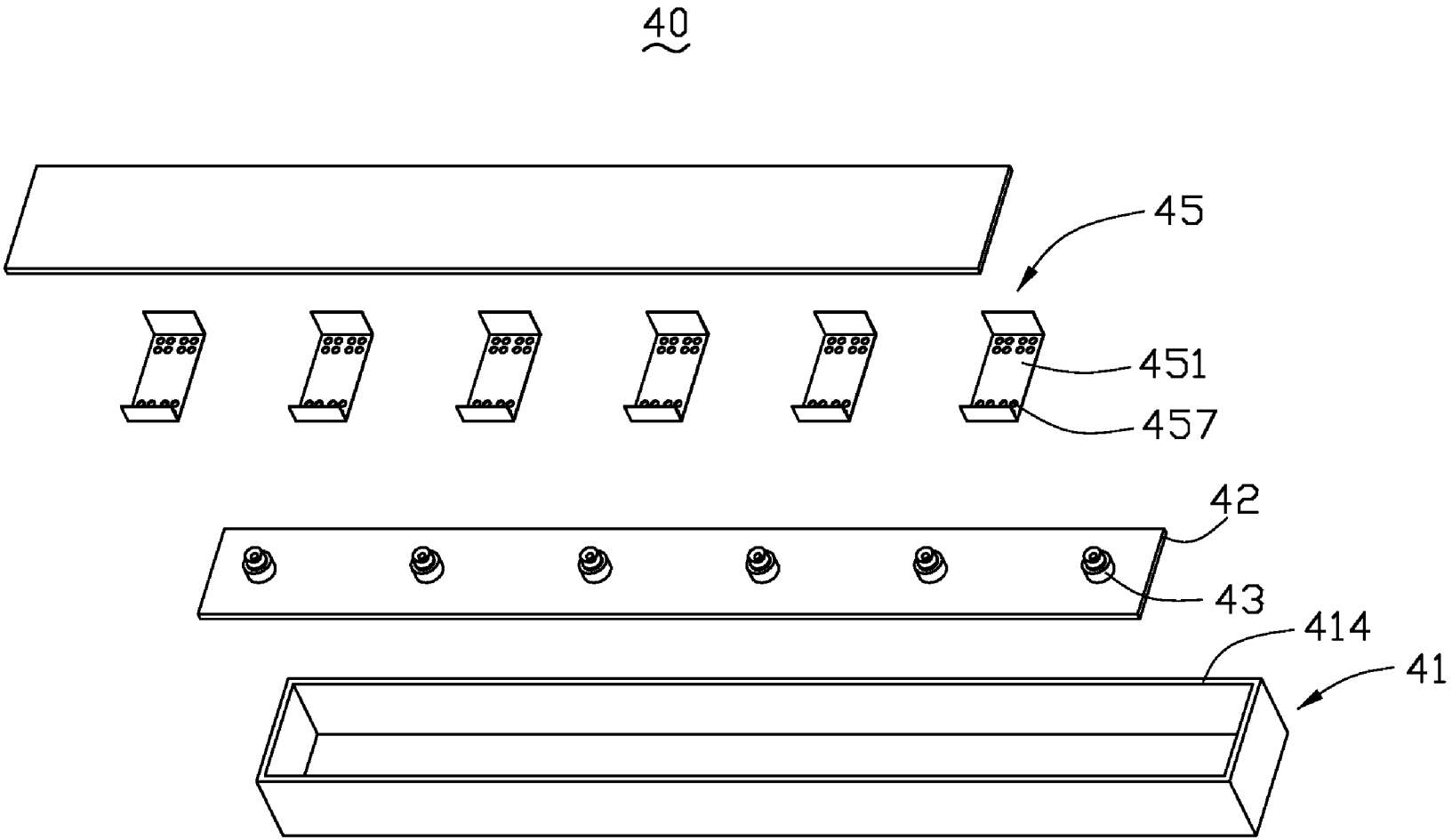
FIG. 7 is an exploded, isometric view of an LED lamp assembly according to a third preferred embodiment of the present invention.
Figure 8:
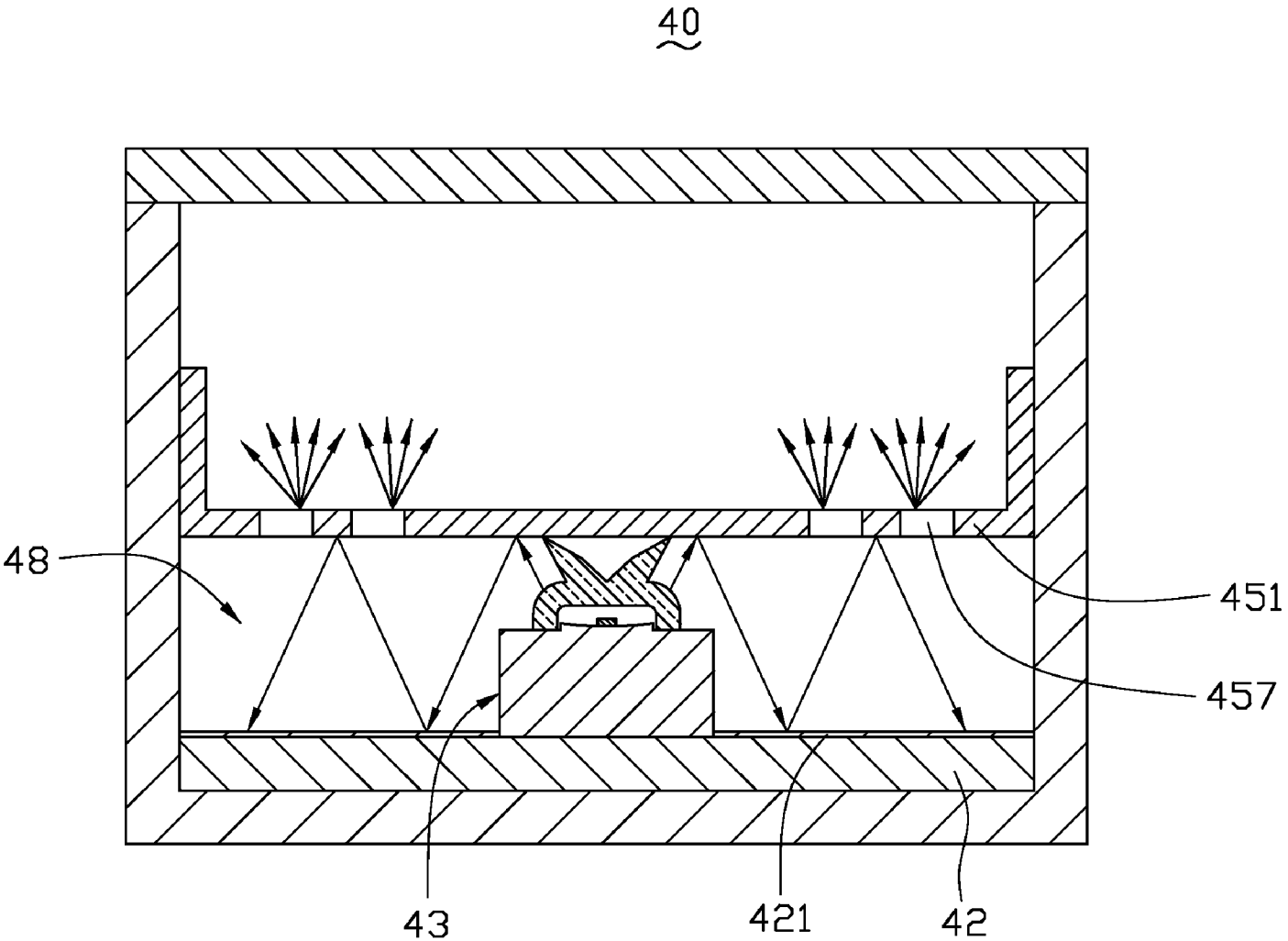
FIG. 8 is a side, enlarged, cross-sectional view of the LED lamp assembly of FIG. 7.

Referring to FIGS. 7 and 8, an LED lamp assembly 40 in accordance with a third preferred embodiment of the present invention is shown. The LED assembly 40 is similar in principle to the LED assembly 20 of the first preferred embodiment, however a high reflective layer 421 is formed on a top surface of the printed circuit board 42 instead of the light reflective element 24 of the LED assembly 20.

The light-shielding sheets 45, the housing 41, and the high reflective layer 421 formed on the top surface of the printed circuit board 42 cooperatively define a light-mixing space 48. Light from LEDs 43 is reflected many times between the high reflective layer 421 and the bottom reflective plate 451 of the light-shielding sheet 45 before substantially exiting at an area between the two adjacent light-shielding sheets 45. As a result, a light brightness above the gaps of the LED lamp assembly 40 is increased. In addition, a light brightness above the LEDs 43 of the LED lamp assembly 40 is decreased due to the light reflection of the light-shielding sheets 45. Furthermore, some of the light projects to the lamp cover 46 via the light holes 457 of the light-shielding sheets 45. Since the light holes 457 are formed on each of the light-shielding sheets 45 adjacent to the sidewalls 414 of the housing 41, a light brightness of the two side portions of the LED lamp assembly 40 is increased. Thus, a uniformity of light output from the LED lamp assembly 40 is increased.

It should be noted that, the high reflective layer 421 formed on the top surface of the printed circuit board 42 can be replaced by a high reflective plate, in order to form a light-mixing space between the high reflective plate and the bottom reflective plate 451 of the light-shielding sheet 45.

It is to be understood that, by selecting the size and shape of the light holes 257, or distribution of the light holes 257, a uniformity of the light brightness above the light-shielding sheets 25 of the LED lamp assembly 20 is adjustable. In an alternative embodiment, in order to obtain a good optical performance such as uniformity of light output from the LED lamps assembly 20, 30,40, each light-shielding sheet 25, 35,45, of the LED lamps assembly 20, 30,40, may have the same distributions as shown in FIGS. 9 through 13.

Figure 9:
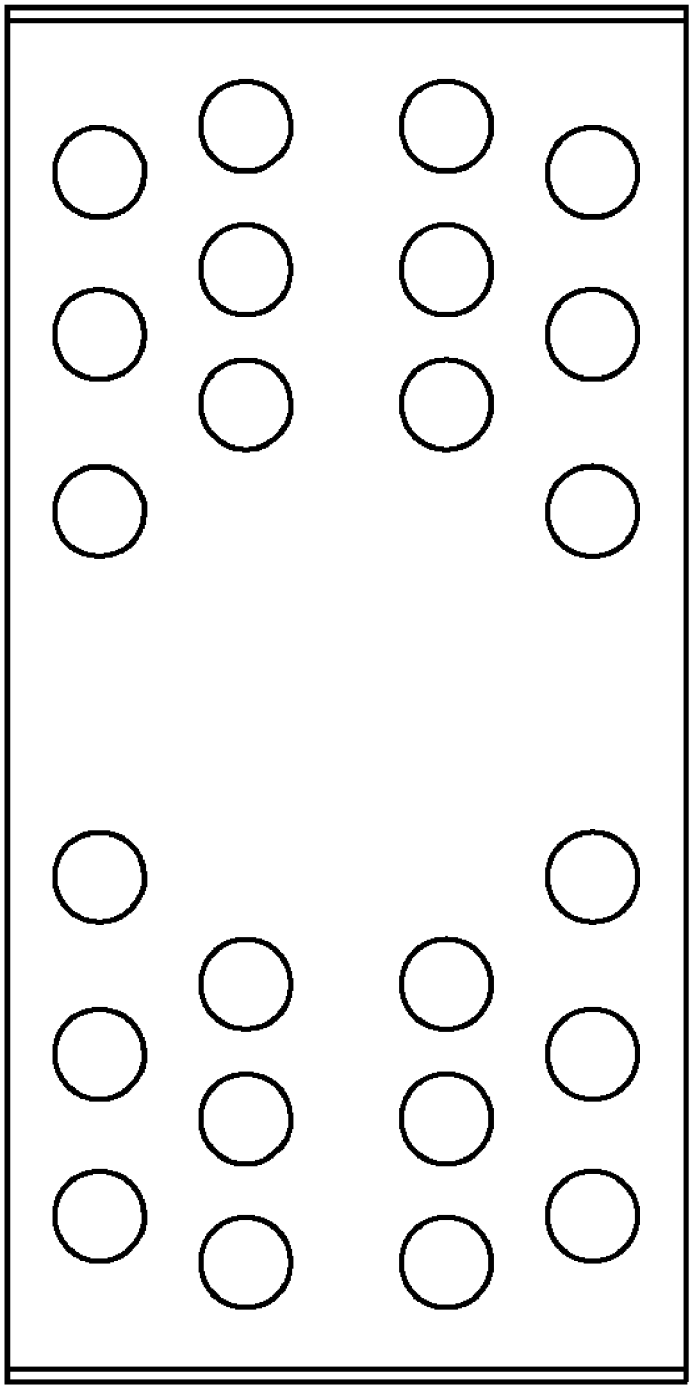
FIGS. 9 through 13 are top plan views of distributions of light holes defined in light-shielding sheets of the LED lamp assembly of the present invention.

Referring to FIG. 9, a distribution of the light holes of a light-shielding sheet is described below. A shape of each of the light holes is circular. The shape and the area of each of the light holes are the same. A mid-point is defined in the light-shielding sheet. The light holes are arranged apart along a plurality of imaginary circles and the center of a row of light holes intersects with the perimeter of an imaginary circle. The imaginary circles have a same center collinear with the mid-point of the light-shielding sheet.

Figure 10:
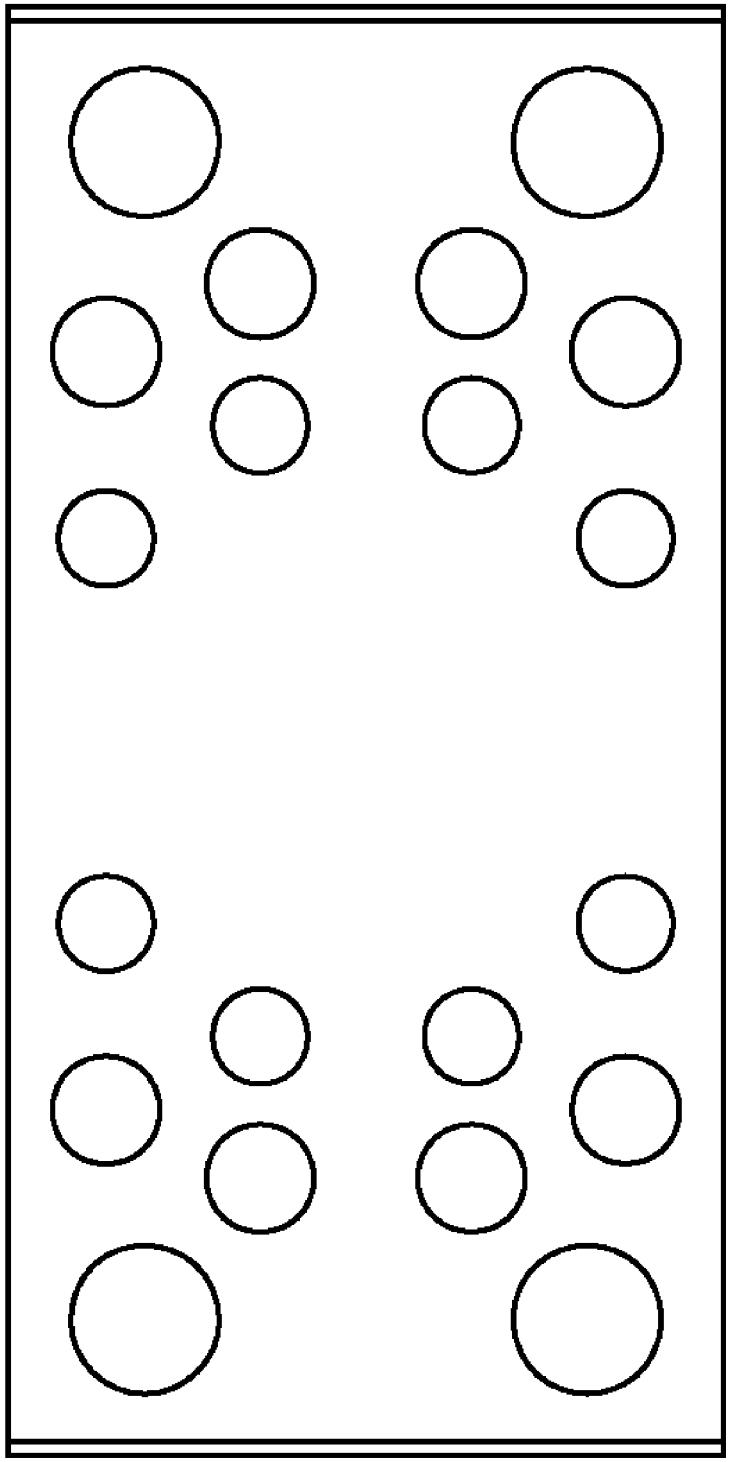

Referring to FIG. 10, a distribution of the light holes of a light-shielding sheet is described below. A shape of each of the light holes is circular, but have a different radius. A mid-point is defined in the light-shielding sheet. The light holes are arranged apart along a plurality of imaginary circles and the center of a row of light holes intersects with the perimeter of an imaginary circle. The imaginary circles have a same center collinear with the mid-point of the light-shielding sheet. The radius of the light holes increase along a direction away from the center of the imaginary circles.

Figure 11:
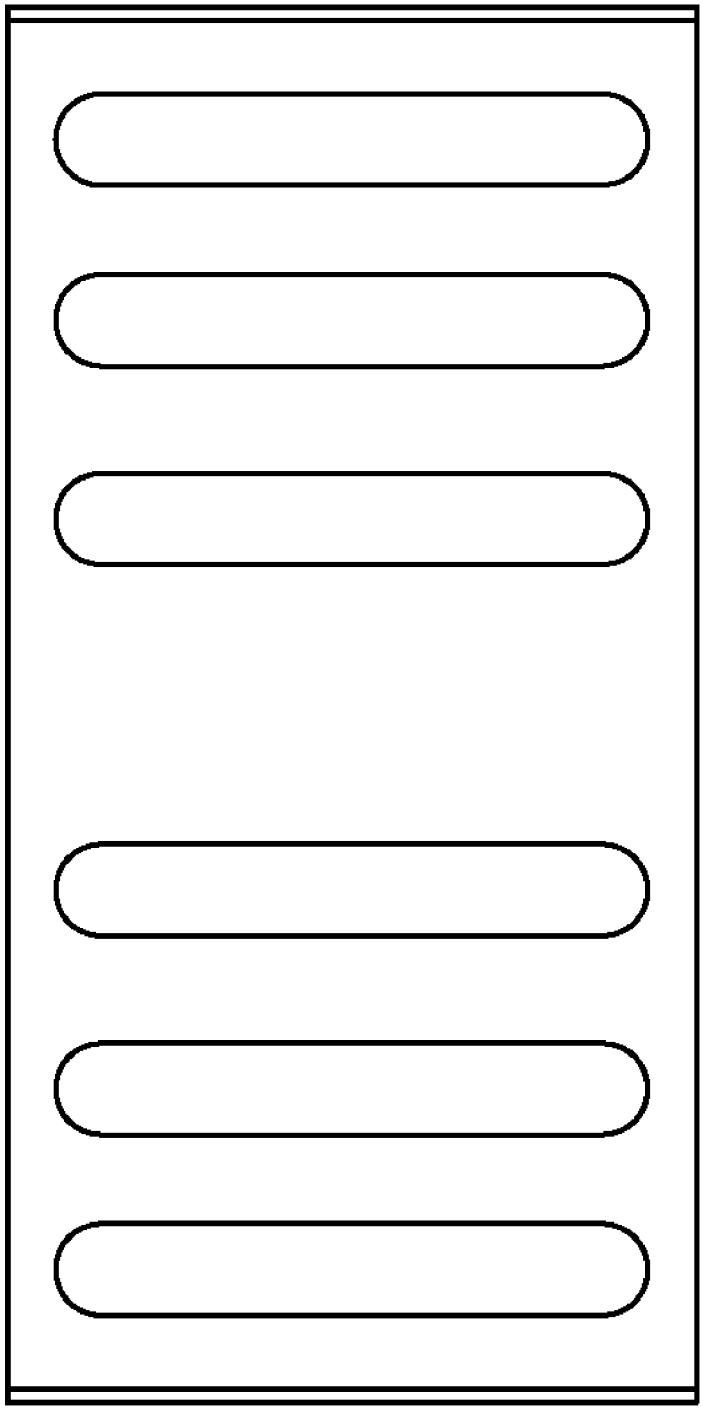

Referring to FIG. 11, a distribution of the light holes of a light-shielding sheet is described below. A shape of each of the light holes is an elongated opening parallel to the sidewalls of the housing of the LED lamp assembly. At each end of the light-shielding sheet, the three light holes are separated to each other uniformly. Length of the three light holes is the same.

Figure 12:
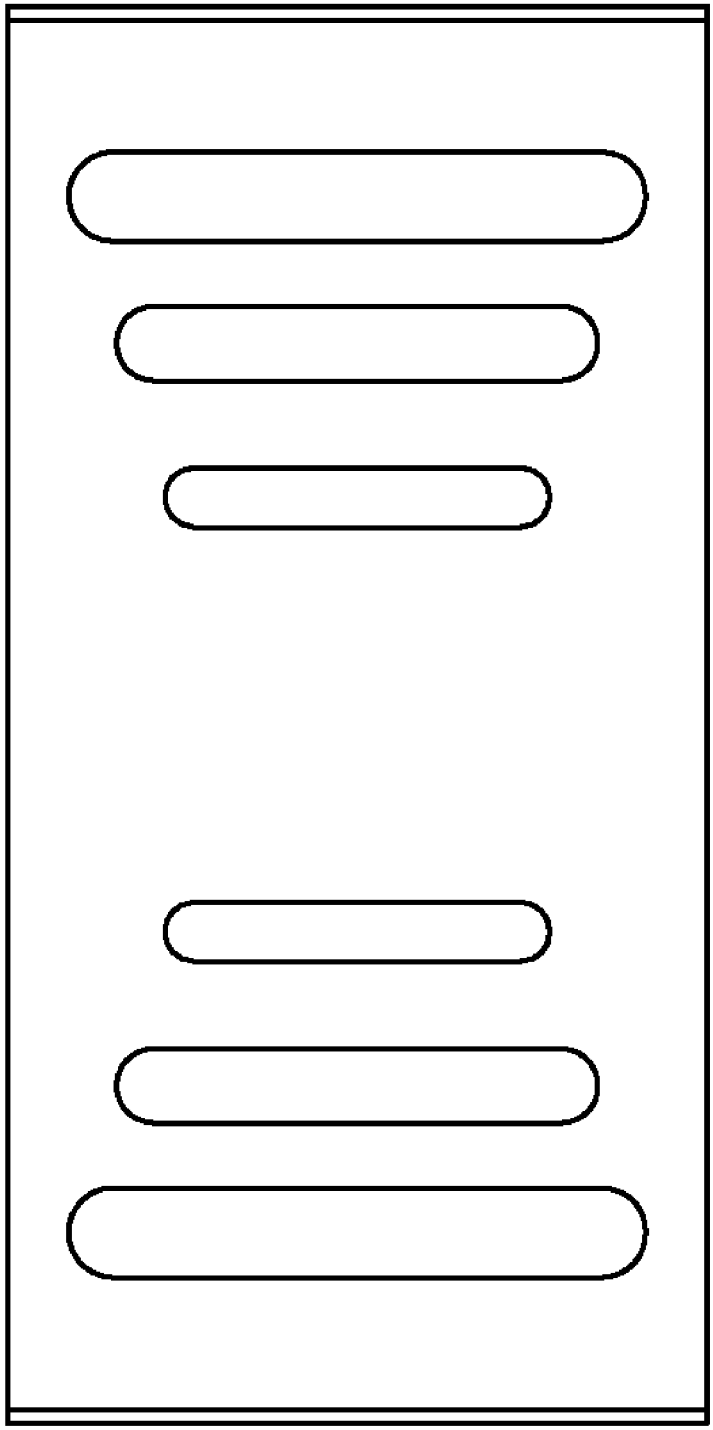

Referring to FIG. 12, a distribution of the light holes of a light-shielding sheet is described below. A shape of each of the light holes is an elongated opening parallel to the sidewalls of the housing of the LED lamp assembly. At each end of the light-shielding sheet, the three light holes are separated to each other uniformly. Lengths of the three light holes progressively increase along a direction away from a middle portion of the light-shielding sheet.

Figure 13:
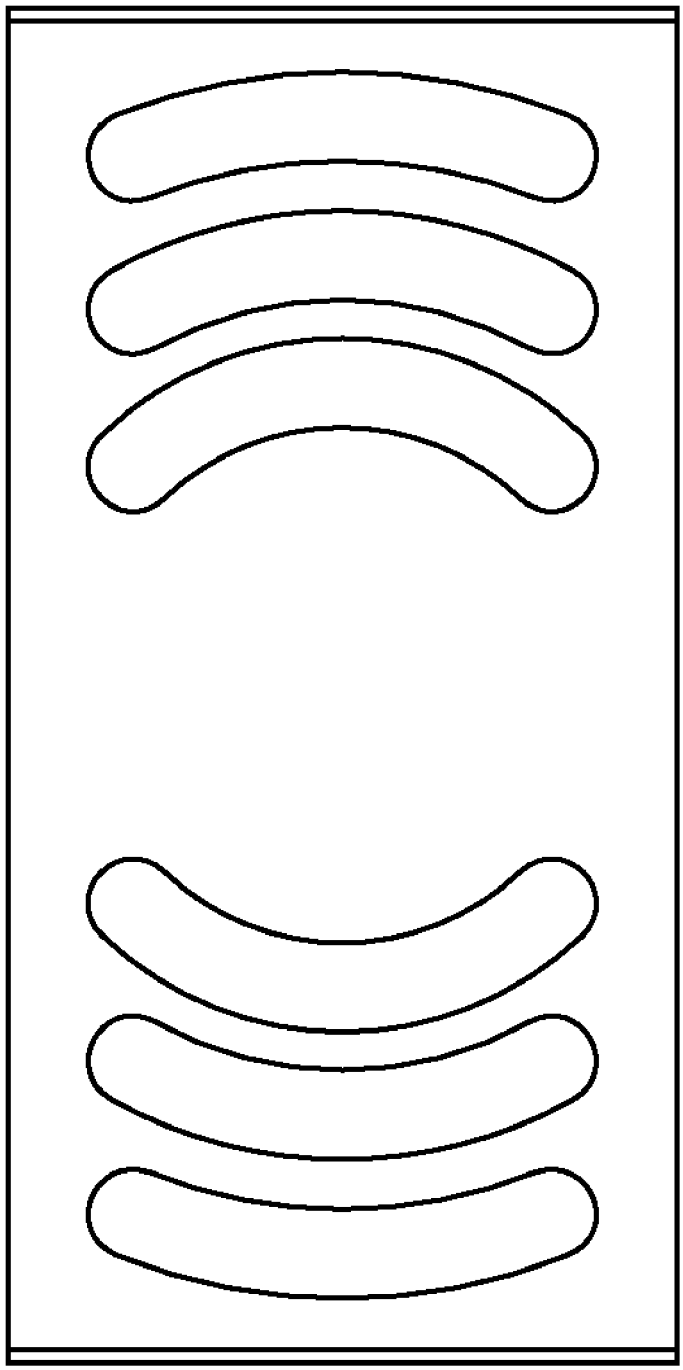

Referring to FIG. 13, a distribution of the light holes of a light-shielding sheet is described below. A shape of each of the light holes is an annular opening. At each end of the light-shielding sheet, the three light holes are separated to each other uniformly. The annular light holes have a same center that is a mid point of the light-shielding sheet.

Finally, while various embodiments have been described and illustrated, the invention is not to be construed as being limited thereto. Various modifications can be made to the embodiments by those skilled in the art without departing from the true spirit and scope of the invention as defined by the appended claims.

What is claimed is:

1. An LED lamp assembly comprising:

a housing defining an opening;

a printed circuit board positioned on a bottom of the housing;

at least one LED electrically connected to the printed circuit board;

a light reflective element defining at least one through hole, and positioned in the housing, the LED passing through the through hole;

at least one light-shielding sheet corresponding to the at least one LED respectively, each light-shielding sheet comprising a bottom reflective plate and a pair of opposite sidewalls extending from two opposite ends of the bottom reflective plate, and a plurality of light holes defined at sides of the bottom reflective plate adjacent to the two opposite sidewalls, wherein the bottom reflective plate is separated from the light reflective element by a predetermined distance, and the sidewalls of the at least one light-shielding sheet is connected to the light reflective element, such that the at least one light-shielding sheet and the light reflective element cooperatively define a light-mixing space; and a lamp cover fixed on the opening of the housing.

2. The LED lamp assembly according to claim 1, wherein the light reflective element comprises a base and a plurality of sidewalls extending from a periphery of the base.

3. The LED lamp assembly according to claim 1, wherein the light reflective element comprises a base and a plurality of sidewalls separating from the base, the base defines at least one through hole.

4. The LED lamp assembly according to claim 1, wherein each LED comprises a base portion, a semiconductor chip fixed on the base portion, and an optical lens, the optical lens being bonded or snap-fitted onto the base portion and sealing the semiconductor chip therein.

5. The LED lamp assembly according to claim 4, wherein the optical lens of the LED passes through the corresponding through hole and the base portion of the LED supports the light reflective element.

6. The LED lamp assembly according to claim 4, wherein the optical lens of the LED passes through the corresponding through hole and the light reflective element is in contact with the printed circuit board.

7. The LED lamp assembly according to claim 1, wherein a surface of the light-shielding sheet is high reflectivity surface.

8. The LED lamp assembly according to claim 1, wherein the light-shielding sheet is made of one of metal materials and plastic materials.

9. The LED lamp assembly according to claim 1, wherein the LED is a side-emitting type LED.

10. The LED lamp assembly according to claim 1, wherein the lamp cover is selected from one of transparent plate and light diffusion plate.

11. The LED lamp assembly according to claim 1, wherein a shape and an area of each of the light holes are the same; a shape of each of the light holes is circular; the light holes are defined at two ends of the light-shielding sheet in a matrix manner.

12. The LED lamp assembly according to claim 1, wherein a shape and an area of each of the light holes are the same; a shape of each of the light holes is circular; a mid-point is defined in the light-shielding sheet; the light holes are arranged apart along a plurality of imaginary circles; the center of a row of light holes intersects with the perimeter of an imaginary circle; and the imaginary circles have a same center collinear with the mid-point of the light-shielding sheet.

13. The LED lamp assembly according to claim 1, wherein a shape of each of the light holes is circular, but having different radii; a mid-point is defined in the light-shielding sheet; the light holes are arranged apart along a plurality of imaginary circles; the center of a row of light holes intersects with the perimeter of an imaginary circle; the imaginary circles have a same center collinear with the mid-point of the light-shielding sheet; and the radius of the light holes increase along a direction away from the mid-point of the light-shielding sheet.

14. The LED lamp assembly according to claim 1, wherein a shape of each of the light holes is an elongated opening parallel to the sidewalls of the housing; the light holes of one side of the light-shielding sheet are equidistant from each other; and the length of the light holes is the same.

15. The LED lamp assembly according to claim 1, wherein a shape of each of the light holes is an elongated opening parallel to the sidewalls of the housing; the light holes of one side of the light-shielding sheet are equidistant from each other; lengths of the light holes are different from each other; and lengths of the light holes, at each edge of the light-shielding sheet, progressively increasing along a direction away from the middle portion of the light-shielding sheet.

16. The LED lamp assembly according to claim 1, wherein a shape of each of the light holes is an annular opening; the light holes of one side of the light-shielding sheet are equidistant from each other; and the annular light holes have a same center that is a middle portion of the light-shielding sheet.

17. An LED lamp assembly comprising:

a housing defining an opening and having highly reflective inner surfaces;

a printed circuit board positioned on a base of the housing;

at least one LED electrically connected to the printed circuit board;

a reflective layer formed on a top surface of the printed circuit board;

at least one light-shielding sheet disposed above the at least one LED correspondingly, wherein each light-shielding sheet comprises a bottom reflective plate and a pair of opposite sidewalls extending from two opposite ends of the bottom reflective plate, and a plurality of light holes defined at ends of the bottom reflective plate adjacent to the two opposite sidewalls, wherein the bottom reflective plate is separated from the housing by a predetermined distance, and the opposite sidewalls are connected to the housing, such that the at least one light-shielding sheet, the housing, and the reflective layer cooperatively define a light-mixing space; and a lamp cover fixed on the opening of the housing.

18. An LED lamp assembly comprising:

a housing defining an opening, and having highly reflective inner surfaces;

a printed circuit board positioned on a bottom of the housing;

at least one LED electrically connected with the printed circuit board;

a reflective plate positioned on a top surface of the printed circuit board;

at least one light-shielding sheet disposed above the at least one LED correspondingly, wherein each light-shielding sheet comprises a bottom reflective plate and a pair of opposite sidewalls extending from two opposite ends of the bottom reflective plate, and a plurality of light holes defined at ends of the bottom reflective plate adjacent to the two opposite sidewalls, wherein the bottom reflective plate is separated from the housing by a predetermined distance, and the opposite sidewalls are connected to the housing, such that the at least one light-shielding sheet, the housing, and the reflective plate cooperatively defining a light-mixing space; and a lamp cover fixed on the opening of the housing.

* * * * *